US008003584B2

(12) United States Patent
Devlin et al.

(10) Patent No.: US 8,003,584 B2
(45) **Date of Patent: *Aug. 23, 2011**

(54) LUBRICANT COMPOSITIONS

(75) Inventors: Mark T. Devlin, Richmond, VA (US); Tze-chi Jao, Glen Allen, VA (US); John T. Loper, Richmond, VA (US); Helen T. Ryan, London (GB); Carl K. Esche, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 555 days.

This patent is subject to a terminal disclaimer.

(21) Appl. No.: 11/457,603

(22) Filed: Jul. 14, 2006

(65) Prior Publication Data

US 2008/0015128 A1 Jan. 17, 2008

(51) Int. Cl.

| | |
|---|---|
| ***C10M 133/06*** | (2006.01) |
| ***C10L 1/22*** | (2006.01) |
| ***B01D 19/04*** | (2006.01) |
| ***C10G 71/00*** | (2006.01) |

(52) U.S. Cl. ..... 508/486; 508/363; 508/558; 508/562; 508/536; 508/551

(58) Field of Classification Search ..... 508/188, 508/363, 558, 562, 379, 537, 551, 486, 433; 208/18, 19

See application file for complete search history.

(56) References Cited

U.S. PATENT DOCUMENTS

| | | | | |
|---|---|---|---|---|
| 3,127,351 | A | 3/1964 | Brown et al. | |
| 3,356,702 | A | 12/1967 | Farmer et al. | |
| 3,509,051 | A | 4/1970 | Farmer et al. | |
| 4,098,705 | A | 7/1978 | Sakurai et al. | |
| 4,164,473 | A | 8/1979 | Coupland et al. | |
| 4,178,258 | A | 12/1979 | Papay et al. | |
| 4,259,195 | A | 3/1981 | King et al. | |
| 4,261,843 | A | 4/1981 | King et al. | |
| 4,263,152 | A | 4/1981 | King et al. | |
| 4,265,773 | A | 5/1981 | de Vries et al. | |
| 4,266,945 | A | 5/1981 | Karn | |
| 4,272,387 | A | 6/1981 | King et al. | |
| 4,283,295 | A | 8/1981 | deVries et al. | |
| 4,285,822 | A | 8/1981 | deVries et al. | |
| 4,362,633 | A | 12/1982 | Spence et al. | |
| 4,369,119 | A | 1/1983 | deVries et al. | |
| 4,395,343 | A | 7/1983 | de Vries et al. | |
| 4,402,840 | A | 9/1983 | deVries et al. | |
| 4,466,901 | A | 8/1984 | Hunt et al. | |
| 4,692,256 | A | 9/1987 | Umemura et al. | |
| 4,765,918 | A | 8/1988 | Love et al. | |
| 4,889,647 | A | 12/1989 | Rowan et al. | |
| 4,966,719 | A | 10/1990 | Coyle et al. | |
| 4,978,464 | A | 12/1990 | Coyle et al. | |
| 4,990,271 | A | 2/1991 | Francis | |
| 4,995,996 | A | 2/1991 | Coyle et al. | |
| 5,137,647 | A | 8/1992 | Karol | |
| 5,230,834 | A | 7/1993 | Gutierrez et al. | |
| 5,282,991 | A | 2/1994 | Malcolm et al. | |
| 5,372,735 | A | 12/1994 | Ohtani et al. | |
| 5,412,130 | A | 5/1995 | Karol | |
| 5,441,656 | A | 8/1995 | Ohtani et al. | |
| 5,891,786 | A | 4/1999 | Srinivasan et al. | |
| 6,103,674 | A | 8/2000 | Nalesnik et al. | |
| 6,117,826 | A | 9/2000 | Baranski et al. | |
| 6,232,276 | B1 | 5/2001 | Stiefel et al. | |
| 6,451,745 | B1 | 9/2002 | Ward | |
| 2002/0072478 | A1 | 6/2002 | Ishida et al. | |
| 2004/0220059 | A1* | 11/2004 | Esche | 508/291 |
| 2005/0043191 | A1 | 2/2005 | Farng et al. | |
| 2005/0101494 | A1 | 5/2005 | Iyer et al. | |
| 2005/0133407 | A1* | 6/2005 | Abernathy et al. | 208/18 |
| 2005/0137096 | A1 | 6/2005 | Yoon et al. | |
| 2005/0241990 | A1* | 11/2005 | Ziemer et al. | 208/19 |
| 2005/0258078 | A1* | 11/2005 | Rosenbaum et al. | 208/950 |
| 2005/0261145 | A1 | 11/2005 | Rosenbaum et al. | |
| 2005/0261146 | A1* | 11/2005 | Rosenbaum et al. | 508/466 |
| 2005/0261147 | A1* | 11/2005 | Rosenbaum et al. | 508/466 |
| 2006/0094607 | A1* | 5/2006 | Devlin et al. | 508/563 |
| 2006/0172898 | A1* | 8/2006 | Roby et al. | 508/485 |
| 2006/0196807 | A1* | 9/2006 | Rosenbaum et al. | 208/19 |
| 2006/0199743 | A1* | 9/2006 | Rosenbaum et al. | 508/110 |
| 2006/0201852 | A1* | 9/2006 | Rosenbaum et al. | 208/19 |
| 2006/0205610 | A1* | 9/2006 | Rosenbaum et al. | 508/110 |
| 2006/0264340 | A1 | 11/2006 | Iyer et al. | |
| 2006/0293193 | A1 | 12/2006 | Rosenbaum et al. | |
| 2007/0238627 | A1* | 10/2007 | Haire et al. | 508/485 |
| 2007/0238628 | A1* | 10/2007 | Haire et al. | 508/591 |

(Continued)

FOREIGN PATENT DOCUMENTS

| | | |
|---|---|---|
| CA | 1 120 461 | 3/1982 |

(Continued)

OTHER PUBLICATIONS

M.T. Devlin, et al., "Effect of Detailed Base Oil Structure on Oxidation Performance of Automatic Transmission Fluids," Proceedings of WTC 2005, Sep. 12-16, 2005, pp, 1-2.

(Continued)

*Primary Examiner* — Glenn A Caldarola

(74) *Attorney, Agent, or Firm* — Luedeka, Neely & Graham, P.C.

(57) ABSTRACT

There is disclosed a lubricating composition comprising a friction modifier and a base oil comprising less than about 3% by weight of tetracycloparaffins. Methods of making and using the composition are also disclosed.

21 Claims, No Drawings

U.S. PATENT DOCUMENTS

| | | | |
|---|---|---|---|
| 2008/0051304 | A1 | 2/2008 | Devlin et al. |
| 2008/0051305 | A1 | 2/2008 | Devlin et al. |

FOREIGN PATENT DOCUMENTS

| | | | |
|---|---|---|---|
| CA | 2487767 | A1 | 5/2005 |
| CN | 1218096 | A | 6/1999 |
| DE | 68923716 | T2 | 3/1996 |
| EP | 0330523 | | 8/1989 |
| EP | 1136496 | A1 | 9/2001 |
| EP | 1136497 | A1 | 9/2001 |
| EP | 1518919 | A1 | 3/2005 |
| EP | 1518921 | A1 | 3/2005 |
| EP | 1 657 293 | | 5/2006 |
| EP | 1661971 | A1 | 5/2006 |
| EP | 1 688 476 | | 8/2006 |
| EP | 1724330 | A1 | 11/2006 |
| EP | 1785476 | A1 | 5/2007 |
| EP | 1900797 | A1 | 3/2008 |
| GB | 530491 | A | 12/1940 |
| GB | 909243 | A | 10/1962 |
| GB | 911491 | A | 11/1962 |
| GB | 2 409 462 | | 6/2005 |
| GB | 2 416 775 | | 2/2006 |
| RU | 2009176 | C1 | 3/1994 |
| RU | 2129141 | C1 | 4/1999 |
| RU | 2276683 | C1 | 5/2006 |
| WO | 97/44413 | A1 | 11/1997 |
| WO | WO 02/064710 | | 8/2002 |
| WO | 03/064568 | A3 | 8/2003 |
| WO | 2005/066314 | A1 | 7/2005 |
| WO | 2005/087901 | A2 | 9/2005 |
| WO | WO 2005/113734 | | 12/2005 |
| WO | WO 2006/099057 | | 9/2006 |
| WO | WO 2007/075831 | | 7/2007 |

OTHER PUBLICATIONS

Analytical Chemistry, 64:2227 (1992).

M. T. Devlin, T. Hammock, and T-C. Jao, "Effect of Mechanical Shear on the Thin Film Properties of Base Oil-Polymer Mixtures", Lubrication Science vol. 14 (2), 2002.

D. Dawson, et al., "Lubrication at the Frontier. The Role of the Interface and Surface Layers in the Thin Film and Boundary Regime," Elsevier Science B.V., 1999, p. 769-766.

R.C. Castle, et al., "The Behavior of Friction Modifiers Under Boundary and Mixed EHD Conditions," SAE 961142, pp. 1-4.

Liza Taylor, et al. "Film-Forming Properties of Zinc-Based and Ashless Antiwear Additives," International Spring Fuels & Lubricants, Paris, France, Jun. 19-22, 2000, pp. 1-11.

M.T. Devlin, et al. "Improved Understanding of Axle Oil Rheology Effects on Torque Transfer Efficiency and Axle Oil Operating Temperature," SAE 2003-01-1972, 2003, pp. 1-10.

Klamann, Dieter: Schmierstoffe und verwandte Produkte. Weinheim, Verlag Chemie, 1982, S. 81-101. ISBN.

German Office Action dated Sep. 4, 2008, from corresponding German patent application.

* cited by examiner

LUBRICANT COMPOSITIONS

FIELD OF THE DISCLOSURE

The present disclosure relates to lubricating compositions comprising a friction modifier and a base oil comprising less than about 3% by weight of tetracycloparaffins.

BACKGROUND OF THE DISCLOSURE

In recent years there has been growing concern to produce energy-efficient lubricated components. Moreover, modern engine oil specifications require lubricants to demonstrate fuel efficiency in standardized engine tests. The thickness and frictional characteristics of thin lubricant films are known to affect the fuel economy properties of oils.

Thin-film friction is the friction generated from fluid, such as a lubricant, pushing between two surfaces, wherein the distance between the two surfaces is very narrow. It is known that different additives normally present in a lubricant composition form films of different thicknesses, which can have an effect on thin-film friction. Moreover, some additives have a narrow range of conditions wherein they provide reduced friction properties to a lubricant composition. Further, some additives, such as zinc dialkyl dithiophosphate (ZDDP) are known to increase thin-film friction.

However, it is also known that some additives are very expensive. And, the use of additional amounts of an additive to a lubricant composition to reduce thin-film friction can be quite costly to the manufacturer.

A major component of a lubricant composition can be the base oil, which is relatively inexpensive. Base oils are known and have been categorized under Groups I-V. The base oils are placed in a given Group based upon their % saturates, % sulfur content, and viscosity index. For example, all Group II base oils have greater than 90% saturates, less than 0.03% sulfur, and a viscosity index ranging from $\geqq 80$ to $\leqq 120$. However, the proportions of aromatics, paraffinics, and naphthenics can vary substantially in the Group II base oils. It is known that the difference in these proportions can affect the properties of a lubricant composition, such as oxidative stability.

What is needed is a lubricant composition that is inexpensive and can provide at least one of reduced thin-film friction and increased fuel economy.

SUMMARY OF THE DISCLOSURE

In accordance with the disclosure, there is disclosed a lubricating composition comprising a friction modifier and a base oil comprising less than about 3% by weight of tetracycloparaffins.

In an aspect, there is disclosed a method of reducing thin-film friction of a fluid between surfaces comprising providing to the fluid a composition comprising a friction modifier and a base oil comprising less than about 3% by weight of tetracycloparaffins.

There is also disclosed a method of increasing fuel efficiency in a vehicle comprising providing to a vehicle a composition comprising a friction modifier and a base oil comprising less than about 3% by weight of tetracycloparaffins.

Further, in an aspect, there is disclosed a method of making a lubricant composition comprising combining a dispersant and a base oil comprising a friction modifier and a base oil comprising less than about 3% by weight of tetracycloparaffins.

Additional objects and advantages of the disclosure will be set forth in part in the description which follows, and can be learned by practice of the disclosure. The objects and advantages of the disclosure will be realized and attained by means of the elements and combinations particularly pointed out in the appended claims.

It is to be understood that both the foregoing general description and the following detailed description are exemplary and explanatory only and are not restrictive of the disclosure, as claimed.

DESCRIPTION OF THE EMBODIMENTS

The present disclosure relates to lubricating compositions comprising a base oil comprising less than about 3% by weight of tetracycloparaffins and a friction modifying compound. The base oil can be any base oil categorized in Groups I-V. In an aspect, the base oil is a Group II base oil. The base oil can comprise less than about 3% by weight, for example less than about 2% by weight, and as a further example less than about 1% by weight of tetracycloparaffins relative to the total weight of the base oil.

The disclosed base oils can have a lower thin-film friction coefficient as compared to base oils not comprising less than 3% by weight of tetracycloparaffins. Moreover, it is believed, without being limited to any particular theory, that when the concentration of base oil structures is reduced the effect of individual additives on thin-film friction is altered. In an aspect, the combination of certain additives with the disclosed base oil can have a synergistic effect.

The base oil can be present in the lubricating composition in any desired or effective amount. For example, the base oil can be present in a major amount. A "major amount" is understood to mean greater than or equal to 50% by weight relative to the total weight of the composition. As a further example, the base oil can be present in an amount greater than or equal to 80%, and as an additional example, greater than or equal to 90% by weight relative to the total weight of the composition.

The friction modifier for use in the disclosed lubricating composition can be selected from among many suitable compounds and materials useful for imparting this function in lubricant compositions. The friction modifier can be used as a single type of compound or a mixture of different types of compounds. Non-limiting examples of the friction modifier include a nitrogen-containing compound, an ash-containing compound, and a non-nitrogen-containing compound. In an aspect, the disclosed lubricating compositions can comprise a non-nitrogen-containing compound and a molybdenum-containing compound.

The nitrogen-containing compound can be any compound that comprises a basic nitrogen. In an aspect, the nitrogen-containing compound can be a long chain alkylene amine. Long chain alkylene amine friction modifying compounds include, for example, N-aliphatic hydrocarbyl-substituted trimethylenediamines in which the N-aliphatic hydrocarbyl-substituent is at least one straight chain aliphatic hydrocarbyl group free of acetylenic unsaturation and having in the range of about 14 to about 20 carbon atoms. A non-limiting example of such friction modifier compounds is N-oleyl-trimethylene diamine. Other suitable compounds include N-tallow-trimethylene diamine and N-coco-trimethylene diamine.

One group of friction modifiers includes the N-aliphatic hydrocarbyl-substituted diethanol amines in which the N-aliphatic hydrocarbyl-substituent is at least one straight chain aliphatic hydrocarbyl group free of acetylenic unsaturation and having in the range of about 14 to about 20 carbon atoms.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, for example no more than one, non-hydrocarbon substituent will be present for every ten carbon atoms in the hydrocarbyl group; typically, there will be no non-hydrocarbon substituents in the hydrocarbyl group.

As discussed above, the friction modifier can comprise a mixture of different compounds, such as a combination of at least one N-aliphatic hydrocarbyl-substituted diethanol amine and at least one N-aliphatic hydrocarbyl-substituted trimethylene diamine in which the N-aliphatic hydrocarbyl-substituent is at least one straight chain aliphatic hydrocarbyl group free of acetylenic unsaturation and having in the range of about 14 to about 20 carbon atoms. Further details concerning this friction modifier combination are set forth in U.S. Pat. Nos. 5,372,735 and 5,441,656, the disclosures of which are hereby incorporated by reference.

The friction modifier can be an ash-containing compound. In an aspect, the ash-containing compound can be a molybdenum-containing compound. The molybdenum-containing compound for use in the lubricating compositions disclosed herein can be sulfur- and/or phosphorus-free. A sulfur- and phosphorus-free molybdenum-containing compound can be prepared by reacting a sulfur and phosphorus-free molybdenum source with an organic compound containing amino and/or alcohol groups. Examples of sulfur- and phosphorus-free molybdenum sources include molybdenum trioxide, ammonium molybdate, sodium molybdate and potassium molybdate. The amino groups can be monoamines, diamines, or polyamines. The alcohol groups can be mono-substituted alcohols, diols or bis-alcohols, or polyalcohols. As an example, the reaction of diamines with fatty oils produces a product containing both amino and alcohol groups that can react with the sulfur- and phosphorus-free molybdenum source.

Examples of sulfur- and phosphorus-free molybdenum-containing compounds appearing in patents and patent applications which are fully incorporated herein by reference include the following: Compounds prepared by reacting certain basic nitrogen compounds with a molybdenum source as defined in U.S. Pat. Nos. 4,259,195 and 4,261,843. Compounds prepared by reacting a hydrocarbyl substituted hydroxy alkylated amine with a molybdenum source as defined in U.S. Pat. No. 4,164,473. Compounds prepared by reacting a phenol aldehyde condensation product, a mono-alkylated alkylene diamine, and a molybdenum source as defined in U.S. Pat. No. 4,266,945. Compounds prepared by reacting a fatty oil, diethanolamine, and a molybdenum source as defined in U.S. Pat. No. 4,889,647. Compounds prepared by reacting a fatty oil or acid with 2-(2-aminoethyl) aminoethanol, and a molybdenum source as defined in U.S. Pat. No. 5,137,647. Compounds prepared by reacting a secondary amine with a molybdenum source as defined in U.S. Pat. No. 4,692,256. Compounds prepared by reacting a diol, diamino, or amino-alcohol compound with a molybdenum source as defined in U.S. Pat. No. 5,412,130. Compounds prepared by reacting a fatty oil, mono-alkylated alkylene diamine, and a molybdenum source as defined in European Patent Application EP 1 136 496 A1. Compounds prepared by reacting a fatty acid, mono-alkylated alkylene diamine, glycerides, and a molybdenum source as defined in European Patent Application EP 1 136 497 A1. Compounds prepared by reacting a fatty oil, diethanolamine, and a molybdenum source as defined in U.S. Pat. No. 4,889,647.

In an aspect, a sulfur-containing, molybdenum-containing compound can also be used in the lubricating compositions disclosed herein. The sulfur-containing, molybdenum-containing compound can be prepared by a variety of methods. One method involves reacting a sulfur- and/or phosphorus-free molybdenum source with an amino group and one or more sulfur sources. Sulfur sources can include for example, but are not limited to, carbon disulfide, hydrogen sulfide, sodium sulfide and elemental sulfur. Alternatively, the sulfur-containing, molybdenum-containing compound can be prepared by reacting a sulfur-containing molybdenum source with an amino group or thiuram group and optionally a second sulfur source. As an example, the reaction of molybdenum trioxide with a secondary amine and carbon disulfide produces molybdenum dithiocarbanates. Alternatively, the reaction of $(NH_4)_2Mo_3S_{13}*n(H_2O)$ where n ranges from about 0 to 2, with a tetralkylthiuram disulfide, produces a trinuclear sulfur-containing molybdenum dithiocarbamate.

Non-limiting examples of sulfur-containing, molybdenum-containing compounds appearing in patents and patent applications include the following: Compounds prepared by reacting molybdenum trioxide with a secondary amine and carbon disulfide as defined in U.S. Pat. Nos. 3,509,051 and 3,356,702. Compounds prepared by reacting a sulfur-free molybdenum source with a secondary amine, carbon disulfide, and an additional sulfur source as defined in U.S. Pat. No. 4,098,705. Compounds prepared by reacting a molybdenum halide with a secondary amine and carbon disulfide as defined in U.S. Pat. No. 4,178,258. Compounds prepared by reacting a molybdenum source with a basic nitrogen compound and a sulfur source as defined in U.S. Pat. Nos. 4,263,152, 4,265,773, 4,272,387, 4,285,822, 4,369,119, 4,395,343. Compounds prepared by reacting ammonium tetrathiomolybdate with a basic nitrogen compound as defined in U.S. Pat. No. 4,283,295. Compounds prepared by reacting an olefin, sulfur, an amine and a molybdenum source as defined in U.S. Pat. No. 4,362,633. Compounds prepared by reacting ammonium tetrathiomolybdate with a basic nitrogen compound and an organic sulfur source as defined in U.S. Pat. No. 4,402,840. Compounds prepared by reacting a phenolic compound, an amine and a molybdenum source with a sulfur source as defined in U.S. Pat. No. 4,466,901. Compounds prepared by reacting a triglyceride, a basic nitrogen compound, a molybdenum source, and a sulfur source as defined in U.S. Pat. No. 4,765,918. Compounds prepared by reacting alkali metal alkylthioxanthate salts with molybdenum halides as defined in U.S. Pat. No. 4,966,719. Compounds prepared by reacting a tetralkylthiuram disulfide with molybdenum hexacarbonyl as defined in U.S. Pat. No. 4,978,464. Compounds prepared by reacting an alkyl dixanthogen with molybdenum hexacarbonyl as defined in U.S. Pat. No. 4,990,271. Compounds prepared by reacting alkali metal alkylxanthate salts with dimolybdenum tetra-acetate as defined in U.S. Pat. No. 4,995,996. Compounds prepared by reacting $(NH_4)_2Mo_3S_{13}*2H_2O$ with an alkali metal dialkyldithiocarbamate or tetralkyl thiuram disulfide as define in U.S. Pat. No. 6,232,276. Compounds prepared by reacting an ester or acid with a diamine, a molybdenum source and carbon disulfide as defined in U.S. Pat. No. 6,103,674. Compounds prepared by reacting an alkali metal dialkyldithiocarbamate with 3-chloropropionic acid, followed by molybdenum trioxide, as defined in U.S. Pat. No. 6,117,826.

Non-limiting examples of molybdenum-containing compounds include molybdenum carboxylates, molybdenum amides, molybdenum thiophosphates, molybdenum thiocarbamates, molybdenum dithiocarbamates, and so forth.

Additional examples of ash-containing compounds include, but are not limited to, titanium-containing compounds and tungsten-containing compounds.

Another suitable group of friction modifiers include non-nitrogen-containing compounds, such as polyolesters, for example, glycerol monooleate (GMO), glycerol monolaurate (GML), and the like.

The friction modifying compound can be present in the lubricating composition in any desired or effective amount. In an aspect, the lubricating composition can comprise from about 0.05% to about 3% by weight, for example from about 0.2% to about 1.5%, and as a further example from about 0.3% to about 1% by weight relative to the total weight of the lubricating composition. However, one of ordinary skill in the art would understand that any amount can be used.

The lubricating compositions disclosed herein can be used to lubricate anything. In an aspect, the lubricating composition can be an engine composition that is used to lubricate an engine. However, one of ordinary skill in the art would understand that the disclosed lubricating compositions can be used to lubricate anything, e.g., any surface, such as those where thin-film friction can be present. Moreover, there is disclosed a method of reducing thin-film friction of a fluid between surfaces comprising providing to the fluid the disclosed composition.

It is further envisioned that the lubricating compositions can be provided to any machinery wherein fuel economy is an issue. In particular, there is disclosed a method of increasing fuel efficiency in a vehicle comprising providing to a vehicle the disclosed composition.

Also disclosed herein is a method of lubricating a machine, such as an engine, transmission, automotive gear, a gear set, and/or an axle with the disclosed lubricating composition. In a further aspect, there is disclosed a method of improving fuel efficiency in a machine, such as an engine, transmission automotive gear, a gear set, and/or an axle comprising placing the disclosed lubricating composition in the machine, such as an engine, transmission, automotive gear, a gear set, and/or an axle.

Optionally, other components can be present in the lubricant composition. Non-limiting examples of other components include antiwear agents, dispersants, diluents, defoamers, demulsifiers, anti-foam agents, corrosion inhibitors, extreme pressure agents, seal well agents, antioxidants, pour point depressants, rust inhibitors and friction modifiers.

EXAMPLES

Example 1

Base Oils

It is known in the industry that Group II base oils comprise more than 90% saturates, less than 0.03% sulfur, and have a viscosity index from about 80 to about 120. However, not all Group iI base oils have the same thin-film frictional properties. The base oils in Table 1 were analyzed according to the procedure in Analytical Chemistry, 64:2227 (1992), the disclosure of which is hereby incorporated by reference, in order to determine the type of paraffins, cycloparaffns, and aromatics in the oil.

The thin-film friction coefficient of various known base oils (three Group II base oils and a PAO) was measured at 100° C./20N load with a 20% slide to roll ratio at 1.5 m/s.

TABLE 1

| Base Oils | Thin-Film Friction Coefficient | Kinematic Viscosity at 100° C. | % Tetracycloparaffins in Base Oil |
|---|---|---|---|
| A | 0.066 | 4.05 cSt | 3.33 |
| B | 0.044 | 4.60 cSt | 1.48 |
| C | 0.030 | 4.09 cSt | 1.57 |
| PAO | 0.027 | 4.00 cSt | 0.00 |

As shown in Table 1, base oil A and base oil C have similar kinematic viscosities, but base oil A has a higher thin-film friction coefficient. Moreover, base oil B has a higher kinematic viscosity as compared to base oil A, but has a lower thin-film friction coefficient. The results for PAO show that in an oil with no tetracycloparaffins thin-film friction is low.

Moreover, as shown in Table 1, those base oils having less than about 3% tetracycloparaffins exhibited a lower thin-film friction. One of ordinary skill in the art would understand that the lower the thin-film friction the better the fuel economy.

Example 2

Base Oils and Friction Modifiers

Various friction modifiers were mixed/blended/combined with each of base oil A and base oil C. The molybdenum-containing compound comprised about 320 ppm of molybdenum. The thin-film friction coefficients were measured as described in Example 1. The results are shown in Table 2.

TABLE 2

| | BASE OIL A | BASE OIL C | PAO |
|---|---|---|---|
| No additive | 0.066 | 0.030 | 0.027 |
| +0.4% Molybdenum-containing compound | 0.062 | 0.056 | 0.058 |
| +0.4% glycerol monooleate | 0.051 | 0.031 | 0.026 |
| +0.1% N-oleyl-trimethylene diamine | | | 0.044 |
| +0.1% diethanolamine | | | 0.019 |
| 0.4% phosphonate | 0.055 | 0.035 | |

The results show that compositions comprising base oil C or PAO and the molybdenum-containing friction modifying compound exhibited increased thin-film friction as compared to compositions comprising glycerol monooleate or phosphonate.

At numerous places throughout this specification, reference has been made to a number of U.S. patents, published foreign patent applications and published technical papers. All such cited documents are expressly incorporated in full into this disclosure as if fully set forth herein.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A lubricating composition comprising a friction modifier and a non-synthetic base oil comprising less than about 3%, and not 0%, by weight of tetracycloparaffins, wherein the friction modifier is at least one of a non-nitrogen-containing compound, a nitrogen-containing compound.

2. The composition of claim 1, wherein the nitrogen-containing compound is a long chain alkylene amine.

3. The composition of claim 2, wherein the long chain alkylene amine is chosen from N-oleyl-trimethylene diamine, N-tallow-trimethylene diamine, coco-trimethylene diamine, and mixtures thereof.

4. The composition of claim 1, wherein the nitrogen-containing compound is diethanolamine.

5. The composition of claim 1, wherein the ash-containing compound is chosen from molybdenum-containing compounds, titanium-containing compounds, and tungsten-containing compounds.

6. The composition of claim 5, wherein the molybdenum-containing compound comprises sulfur.

7. The composition of claim 5, wherein the molybdenum-containing compound is chosen from molybdenum carboxylates, molybdenum amides, molybdenum thiophosphates, molybdenum thiocarbamates, and mixtures thereof.

8. The composition of claim 1, wherein the non-nitrogen-containing compound is a polyolester.

9. The composition of claim 8, wherein the polyolester is chosen from glycerol monooleate and glycerol monolaurate.

10. The composition of claim 1, wherein the non-nitrogen-containing compound comprises phosphorus.

11. The composition of claim 10, wherein the non-nitrogen containing compound comprising phosphorus is a phosphonate.

12. A method of reducing thin-film friction of a fluid between surfaces comprising providing to the fluid a composition comprising a friction modifier and a non-synthetic base oil comprising less than about 3%, and not 0%, by weight of tetracycloparaffins, wherein the friction modifier is at least one of a non-nitrogen-containing compound, and a nitrogen-containing compound.

13. The method of claim 12, wherein the friction modifier is at least one of a non-nitrogen-containing compound, a nitrogen-containing compound, and an ash-containing compound.

14. The method of claim 13, wherein the nitrogen-containing compound is a long chain alkylene amine.

15. The method of claim 13, wherein the ash-containing compound is chosen from molybdenum-containing compounds, titanium-containing compounds, and tungsten-containing compounds.

16. A method of increasing fuel efficiency in a vehicle comprising providing to a vehicle a composition comprising a friction modifier and a non-synthetic base oil comprising less than about 3%, and not 0%, by weight of tetracycloparaffins, wherein the friction modifier is at least one of a non-nitrogen-containing compound, and a nitrogen-containing compound.

17. An engine, transmission or gear set lubricated with a lubricant composition according to claim 1.

18. A method of making a lubricant composition comprising combining a dispersant and a base oil comprising a friction modifier and a non-synthetic base oil comprising less than about 3%, and not 0%, by weight of tetracycloparaffins, wherein the friction modifier is at least one of a non-nitrogen-containing compound, and a nitrogen-containing compound.

19. A method for lubricating a machine comprising providing to the machine the lubricant composition of claim 1.

20. The method of claim 19, wherein the machine is a gear.

21. The method of claim 19, wherein the machine is an engine.

* * * * *